US005275315A

United States Patent [19]

Carmack et al.

[11] Patent Number: 5,275,315

[45] Date of Patent: Jan. 4, 1994

[54] WAIST PACK WITH CUSHION SEAT

[76] Inventors: Robert D. Carmack; Elaine Carmack, both of 13901 Olive View Lane, Unit 38, Sylmar, Calif. 91342

[21] Appl. No.: 11,533

[22] Filed: Feb. 1, 1993

Related U.S. Application Data

[63] Continuation-in-part of Ser. No. 929,026, Aug. 13, 1992, abandoned.

[51] Int. Cl.[5] ..... A45C 15/00

[52] U.S. Cl. ..... 224/151; 224/253; 224/226; 297/4; 5/654; 5/656; 2/94

[58] Field of Search ..... 2/66, 1, 2, 69, 69.5, 2/94, 310, 311, 312, 333, 267, 268, DIG.; 5/417, 420, 653, 654, 656, 657, 644, 458; 297/4, DIG.; 224/224, 226, 227, 151, 253

[56] References Cited

U.S. PATENT DOCUMENTS

| | | | |
|---|---|---|---|
| 1,267,953 | 5/1918 | Zolp | 297/4 |
| 1,626,166 | 4/1927 | Stair | 2/94 |
| 1,723,831 | 8/1929 | Weymouth | 297/4 |
| 3,185,362 | 5/1965 | Wakefield | 297/4 X |
| 4,515,300 | 5/1985 | Cohen | 224/253 X |
| 5,150,824 | 9/1992 | Alvarez et al. | 224/226 X |

*Primary Examiner*—Clifford D. Crowder
*Assistant Examiner*—Jeanette E. Chapman
*Attorney, Agent, or Firm*—Jack C. Munro

[57] ABSTRACT

A waist pack adapted to be worn about the waist of a human which includes at least one interior compartment. Connecting to the waist pack by means of a connecting strap is a seat cushion. The connecting strap and the seat cushion are locatable in a stowage position within an interior compartment of the waist pack in a first embodiment. In a second embodiment, the seat cushion is rolled-up onto the connecting strap and secured. The connecting strap and the seat cushion are movable to an extended position, the seat cushion being inflatable and then to be used by being positioned under the buttocks of the human when in a sitting position.

5 Claims, 3 Drawing Sheets

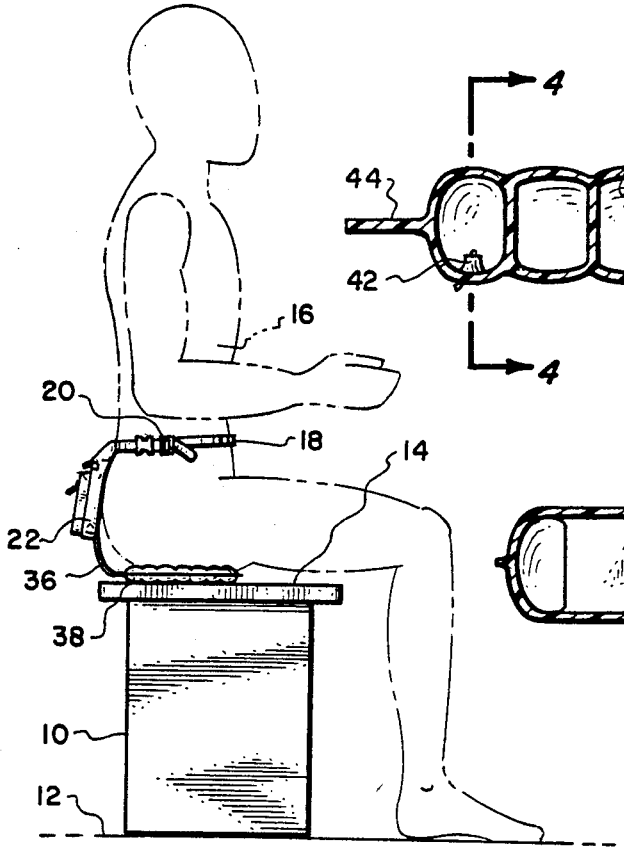
Fig. 1.
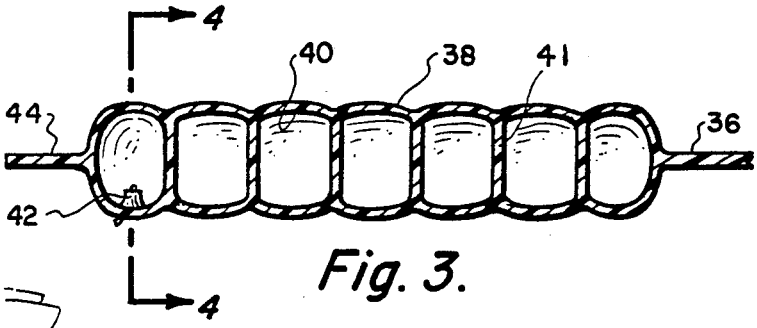
Fig. 3.
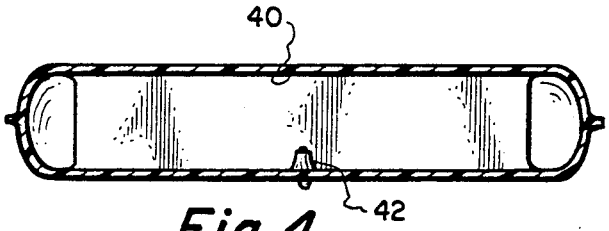
Fig. 4.
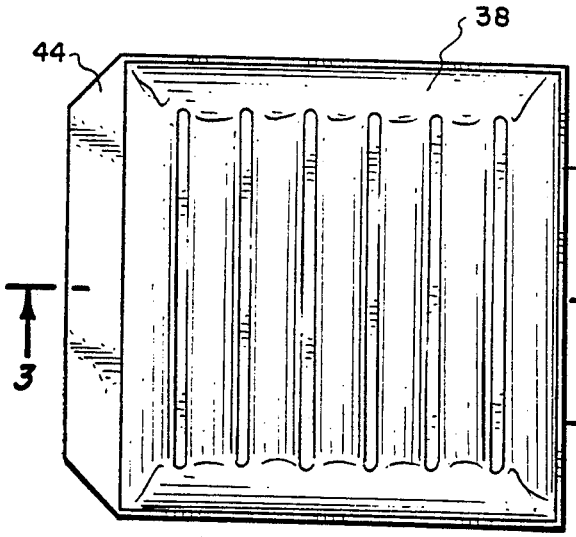
Fig. 2.
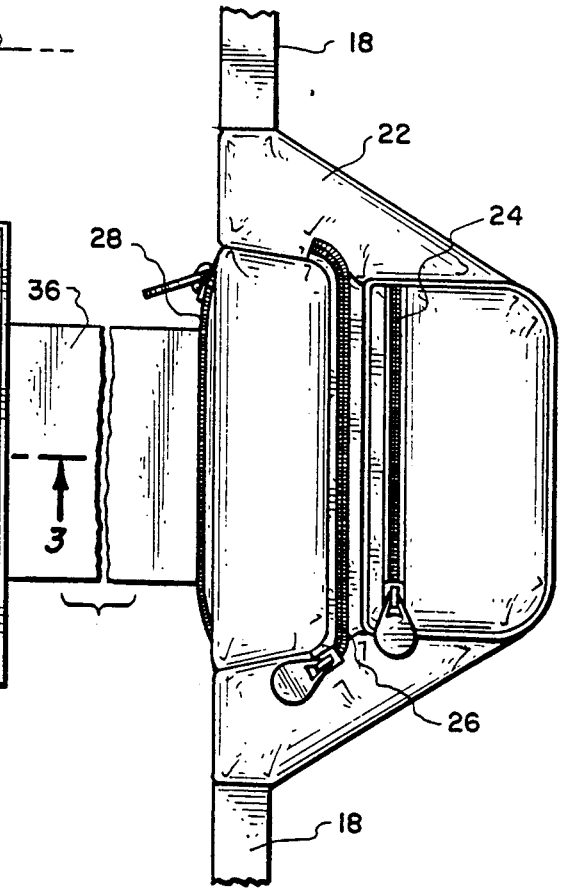

WAIST PACK WITH CUSHION SEAT

REFERENCE TO PRIOR APPLICATION

This application is a Continuation-In-Part of patent application Ser. No. 07/929,026 abandoned, filed Aug. 13, 1992, by the same title and same inventors.

BACKGROUND OF THE INVENTION

1) Field of the Invention

The field of this invention relates to human wearing apparel and more particularly to a pack that is to be worn about the waist of a human which includes a seat cushion to be usable by the human when sitting.

2) Description of the Prior Art

Humans long have carried articles on their person. As the humans engage in normal daily activities, the human male frequently carries articles within a billfold and within pockets of trousers. The human female has been known to carry articles within a purse. The purse can either be hand carried or carried by a shoulder strap on the woman.

Purses as well as billfolds are subject to being lost or stolen. Stealing of purses and billfolds is common in crowded environments. Typical crowded environments are streets within cities or within recreational facilities such as theme parks, zoos and so forth.

Within recent years a new form of article carrying device has evolved. This new form of article carrying device constitutes a waist pack. The waist pack is formed of a sheet material fabric which is composed of and has several interior compartments. It is within these interior compartments that the articles are to be stored. The waist pack is to be mounted about the waist of a human and can actually be either worn against the stomach of the human or can fit against the small of the back of the human. If the waist pack is worn against the stomach of the human there is less chance of stealing than if the waist pack is worn at the small of the back. However, even with the waist pack being worn at the small of the back, it is very difficult for any article contained in the waist pack to be stolen. The mere use of the waist pack, because it is attached to the person, makes it very unlikely that it will be accidentally mislayed which is a relatively common occurence having to do with billfolds and purses.

In certain environments humans have a need for a seat cushion. One example of such an environment would be a sporting event where the humans are required to sit on a seat or bench for the extended period of time of the sporting event. An example of such a sporting event would be an automobile race, a football game, soccer match and so forth. It is common for humans in such instances to purchase or bring with them a seat cushion because these benches or seats at the sporting event are quite hard and can become uncomfortable rather quickly. However, this requires that the individual carries something additionally. Inherently such carrying of an item is inconvenient.

SUMMARY OF THE INVENTION

The primary objective of the present invention is to incorporate a seat cushion in conjunction with a waist pack thereby eliminating the need to carry a separate seat cushion to an environment where there is a need for a seat cushion.

Another objective of the present invention is to incorporate a seat cushion with a wait pack to facilitate portability during non-usage of the seat cushion.

Another objective of the present invention is to construct a waist pack which includes a seat cushion which can be manufactured relatively inexpensively and therefore sold to the ultimate consumer at a very inexpensive price.

The first embodiment of the present invention utilizes a conventional waist pack which has a plurality of interior compartments. Within one of the interior compartments is located a seat cushion in a collapsed state. The seat cushion is attached to a connecting strap which in turn is fixed to the wall of the interior chamber within which it is located. Normally this interior chamber is closed by a zipper. The zipper can be unzipped and the seat cushion and the connecting strap moved to an extended position. Normally this seat cushion is to be inflated so that it will be soft so that when the user sits on it it will have a cushiony effect. The connecting strap is of sufficient length so that the seat cushion can be located under the buttocks when the user is in the sitting position. It may be desireable to fix the position of the seat cushion and keep it from "flopping around". To avoid this, the seat cushion may include a stabilizing strap which connects to the seat cushion on the side of the seat cushion opposite the connecting strap. The stabilizing strap terminates in a belt attachment. This belt attachment is to be attachable to the belt upon which the waist pack is located. The second embodiment of this invention locates the seat cushion in a rolled-up state but not inside a packet. It is maintained in the rolled-up state by snap fasteners. When the snap fasteners are released, the seat cushion can be moved to the extended position and inflated.

BRIEF DESCRIPTION OF THE DRAWINGS

FIG. 1 is a side elevational view showing the first embodiment of waist pack and seat cushion combination of the present invention being utilized by a human;

FIG. 2 is a longitudinal front view of the first embodiment of the present invention showing the seat cushion in an extended position from the waist pack;

FIG. 3 is a longitudinal cross sectional view through the seat cushion incorporated in conjunction with the first embodiment of the present invention taken along line 3—3 of FIG. 2;

FIG. 4 is a transverse cross-sectional view through the seat cushion incorporated within the first embodiment of the present invention taken along line 4—4 of FIG. 3;

DETAILED DESCRIPTION OF THE SHOWN EMBODIMENT

Figure 5:
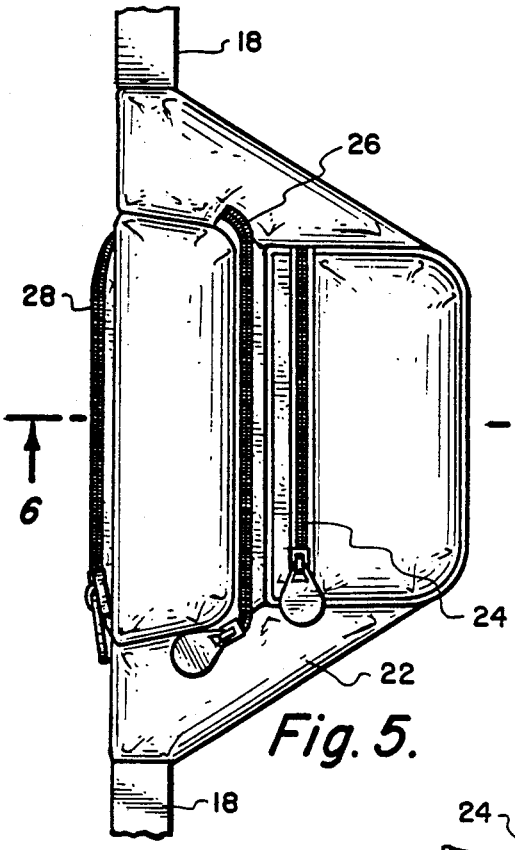
FIG. 5 is a view of the waist pack similar to what is shown in FIG. 2 where the seat cushion is located in the stowage position within the waist pack.

Referring particularly to FIGS. 1 to 9 of the drawings, there is shown the first embodiment of this invention. In FIG. 1 there is shown a pedestal 10 which is fixedly mounted on a supporting surface 12. Pedestal 10 is designed as a bench that might possibly be located within the spectator area of a sporting event. On the pedestal 10 is mounted a seat 14. A human 16 is capable of sitting on the seat 14.

Mounted about the waist of the human 16 is a belt 18. The belt 18 connects with a belt buckle latching system 20 that is deemed to be conventional and forms no specific part of this invention. Mounted on the belt 18 is a waist pack 22. The waist pack will normally be constructed of a flexible sheet material such as a fabric. The waist pack 22 has a first interior compartment 32 which is normally closed by a zipper 24, a second interior compartment 34 which is closed by a zipper 26 and a third interior compartment 30 which is normally closed by a zipper 28. Compartments 34 and 32 are to be used to store articles (not shown) that are to be carried by the human 16. The compartment 30 is utilized to store a seat cushion 38 and connecting strap 36 when in the stowage position.

Connecting strap 36 comprises a length of thin sheet material which normally will be plastic or other type of sheet material such as a fabric. Connecting strap 36 is fixedly connected to the wall of the interior compartment 30. The outer end of the connecting strap 36 is fixedly secured to a seat cushion 38. The seat cushion 38 is interiorly constructed of a plurality of interconnected cells 40. The cells 40 are divided by wall members 41. Inflation of the cushion 38 is accomplished manually by means of air inflating valve 42. The outer exterior edge of the seat cushion 38 terminates in a outwardly extending flange 44.

Figure 6:
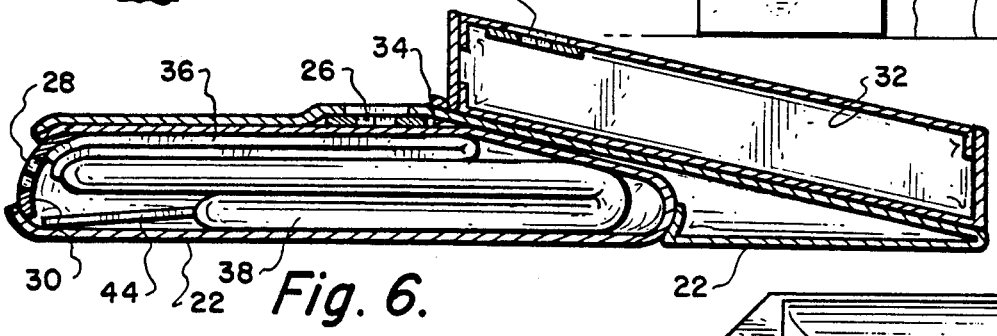
FIG. 6 is a cross-sectional view through the waist pack of FIG. 5 taken along line 6—6 of FIG. 5.
Figure 8:
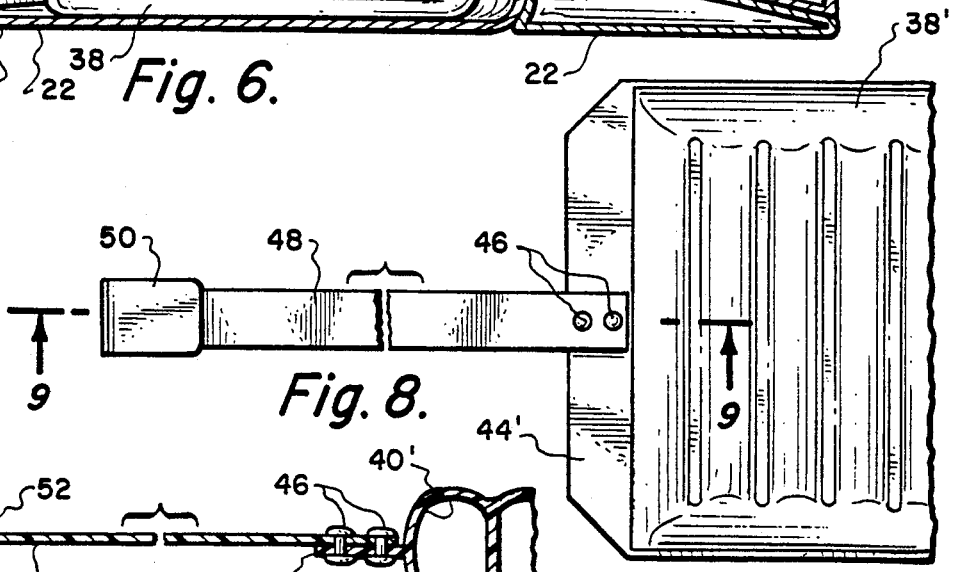
FIG. 8 is a top plan view of a portion of the seat cushion of FIG. 7 showing clearly the stabilizing strap that is utilized in conjunction with the seat cushion.
Figure 9:
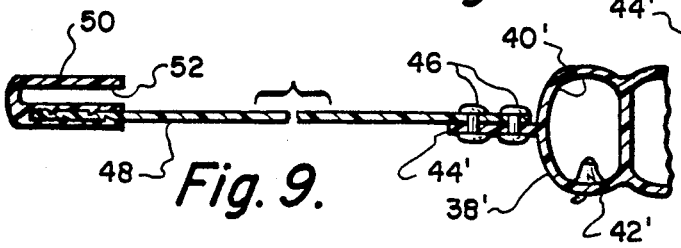
FIG. 9 is a cross-sectional view through the modified structure taken along line 9—9 of FIG. 8.

Let it be assumed that the seat cushion 38 is in the stowage position as is shown in FIG. 6 of the drawing. Let it now be assumed that the user 16 wishes to extract the seat cushion 38 and use such as is shown in FIG. 1. The user unzips zipper 28 and physically removes the seat cushion 38 and the connecting strap 36 to the position shown in FIG. 2 of the drawings. The user then, by utilizing valve 42, inflates the seat cushion 38. The user then places the cushion 38 under his or her buttocks and sits on the cushion on the seat 14 as is shown in FIG. 1.

When it is desired that the seat cushion 38 no longer be utilized, the user opens valve 42 and extract as much as possible of the air from the cushion 38. The user then rolls up the seat cushion 38 and the connecting strap 36 and places such back in the interior compartment 30 and then closes the zipper 28.

Figure 7:
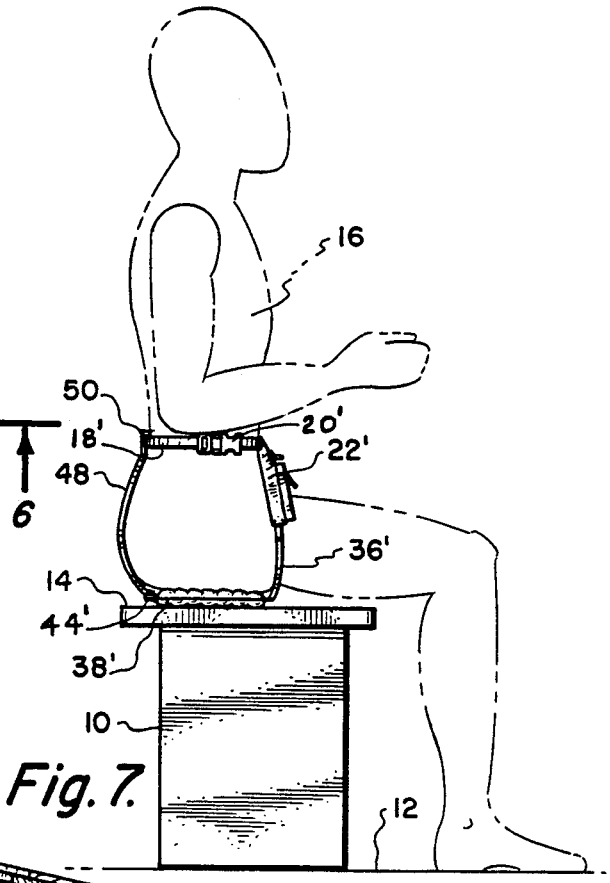
FIG. 7 is a side view similar to FIG. 1 but showing the human using a modified form of waist pack combined with seat cushion of the present invention.

The cushion 38 shown in FIGS. 1 through 6 is only attached by the connecting strap 36. It may be desirable to stable not only the rear portion of the seat cushion 38 but also the front portion of the seat cushion 38. Referring particularly to FIG. 7, the waist pack 22' is shown mounted against the stomach area of the human 16 rather than against the back area as shown in FIG. 1. Seat cushion 38' is connected by connecting strap 36' to the waist pack 22'. The belt 18' mounts the waist pack 22' on the waist of the user. Connecting with the belt 18' is the belt buckle assembly 20'.

The seat cushion 38' has an outwardly extending flange 44' which is essentially identical to previously discussed flange 44. Fixedly mounted on the flange 44' by means of rivets 46 is a stablizing strap 48. This stabilizing strap 48 is fixedly secured to a U-shaped belt attachment 50 which includes an internal groove 52. The belt 18' is to be locatable within the internal groove 52 thereby fixing in position seat cushion 38' against the buttocks of the user 16 to prevent such from "flopping around" which would occur within the embodiment of the structure shown in FIGS. 1 to 6. Seat cushion 38' includes a plurality of spaced-apart interior cells 40' with the entire seat cushion 38' being inflatable by means of air valve 42'.

Referring particularly to FIGS. 10 to 13 of the drawings there is shown the second embodiment 54 of the waist pack and seat cushion combination of this invention. The second embodiment 54 is mounted in a similar manner as is the first embodiment by means of a waist strap assembly 56 about the waist area of the human user 58. The human user 58 is shown in a seated position on a pedestal or bench 60.

The waist strap assembly 56 pass through a loop section 62. Connected to the loop section 62 is a pocket section 64. The pocket section 64 permits the storage of separate articles that are not shown. Pocket section 64 can be closed by means of flange 66. Connecting between the pocket section 64 and the flange 66 are a pair of snap fasteners 68. These snap fasteners 68 can be readily engaged and disengaged and when these snap fasteners 68 are engaged the pocket section 64 is closed. When the snap fasteners 68 are disengaged, access into and out of the internal compartment 70 of the pocket section 64 is permitted.

Connecting between the pocket section 64 and the inflatable seat cushion 72 is a connecting strap section 74. Associated with the connecting strap section 74 is a flange 76. Mounted on the flange 76 are also a pair of snap fasteners 78. It is to be understood that the snap fasteners 78 are essentially identical to the snap fasteners 68. The seat cushion 72 has an extending flange 80 which is fixedly mounted by rivets 82 to the strap section 74.

The seat cushion 72 has a plurality of spaced apart sealed areas 84 so as to define somewhat of a plurality of separate inflated compartments 86. However, the compartments 86 are all interconnected so that they can be inflated by merely using the single inflation valve 88.

The seat cushion 72 includes a forward extending flange 90. This flange 90 is pivotally connected by rivet 92 to the inner end of a stabilizing strap 94. The outer end of the stabilizing strap 94 is connected to a belt attachment section 96 which is to be used to facilitate attachment to the waist strap assembly 56. This belt attachment section 96 is to be adjustable so as to accommodate to a particular size of user. Also to accommodate to the specific size of the user, the stabilizing strap 94 is to be pivotable about the rivet 92 so as to be movable slightly to various positions so as to permit locating of the stabilizing strap 94 in the most comfortable position.

Figures 10, 11, 12, 13:
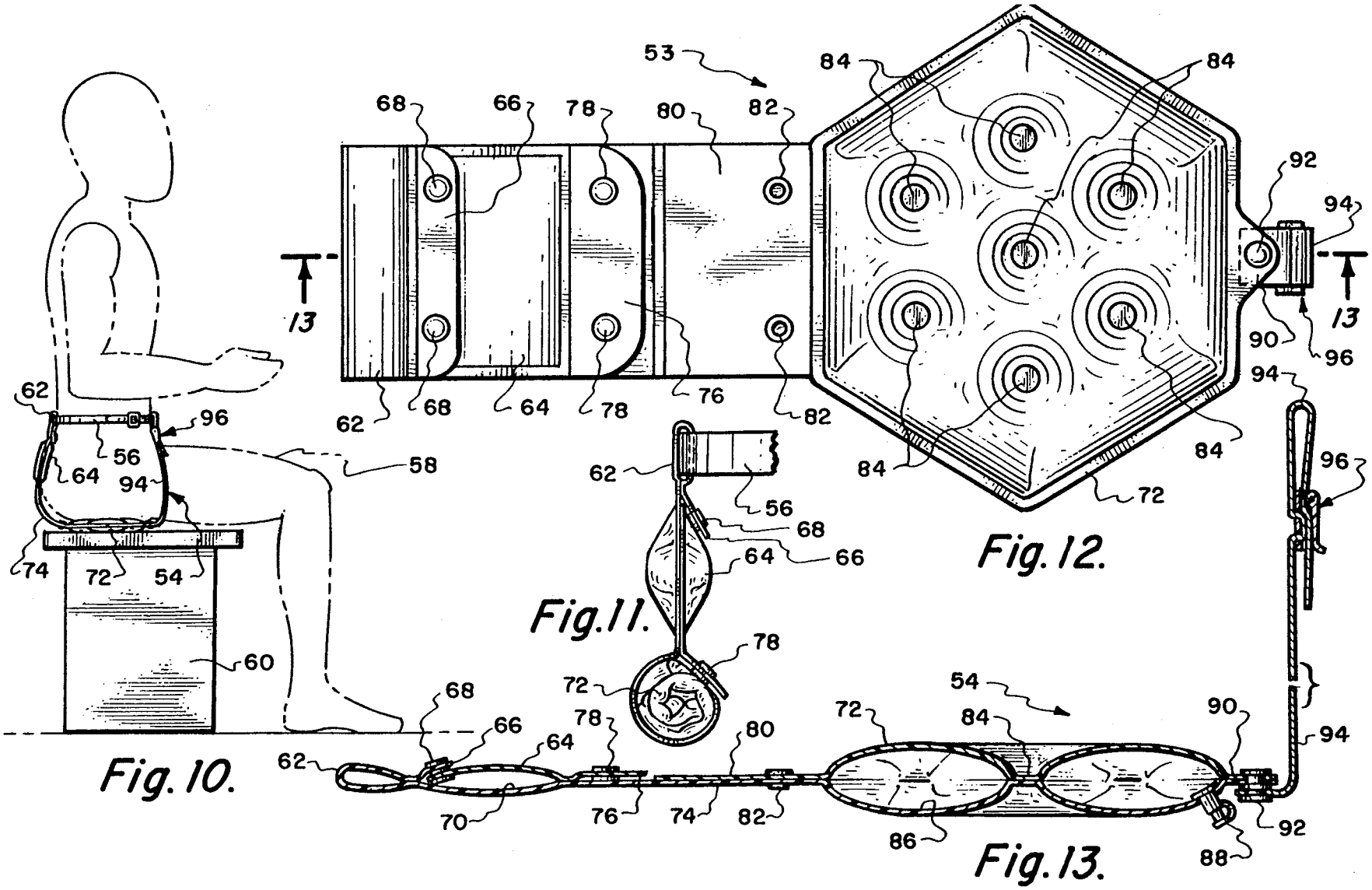
FIG. 10 is a view similar to FIG. 1 showing a second embodiment of waist pack and seat cushion combination of the present invention.
FIG. 11 is a side elevational view of the second embodiment of waist pack and seat cushion combination of the present invention showing the waist pack and seat cushion in the rolled-up stowage position.
FIG. 12 is an exterior view of the second embodiment of the waist pack and seat cushion combination of the present invention showing such in the extended position.
FIG. 13 is a cross-sectional view through the second embodiment of the waist pack and seat cushion combination of the present invention taken along line 13—13 of FIG. 12.

It is to be noted that the seat cushion 72 is of a hexagonal configuration as is shown in FIG. 12. Also the seat cushion 72 has a width substantially greater than the width of connecting strap 74. It is desirable to have the overall width of the waist pack as small as possible and it is for this reason that connecting strap 74 and extending flange 80 be as narrow as possible along with the pocket section 64 and the belt loop 62. When the seat cushion 72 is deflated, the portions of the seat cushion 72 that extend laterally outward greater than the width of the connecting strap 74 are folded inwardly upon the inner portion of the seat cushion 72. The stabilizing strap 94 and the seat cushion 72 is then rolled up as is clearly shown in FIG. 11. When the seat cushion 72 is in the completely rolled-up configuration, the snap fasteners 78 are capable of securingly engaging with the rivets 82 thereby securing the seat cushion 72 in the rolled up position for stowage. This stowage position would be normally when the waist pack and combination seat cushion is carried at the small of the back of the user 58.

What is claimed is:

1. In combination with a waist pack adapted to be worn about the waist of a human by a waist strap assembly, said waist pack having at least one interior compartment, the improvement comprising:

a thin planar connecting strap attached to said waist pack, said connecting strap having a first width;

an inflatable seat cushion attached to said connecting strap, said seat cushion having a second width, said second width being greater than said first width; and when said seat cushion is deflated said seat cushion being capable of being rolled up on said connecting strap to a compact position, with said seat cushion in said compact position said seat cushion being decreased in width to said first width, said seat cushion and said connecting strap being movable to an extended position permitting location of said seat cushion when inflated under the buttocks of a human when located in a sitting position.

2. The combination as defined in claim 1 wherein:

snap fasteners being used to secure said seat cushion in said compact position.

3. The combination as defined in claim 2 wherein:

a stabilizing strap connected to said seat cushion, said stabilizing strap being oppositely located to said connecting strap relative to said seat cushion, said stabilizing strap being connectable to said waist strap assembly to locate said seat cushion in said extended position and against the buttocks of the human.

4. The combination as defined in claim 3 wherein:

said stabilizing strap being pivotably mounted on said seat cushion.

5. The combination as defined in claim 4 wherein:

said stabilizing strap including a belt attachment, said belt attachment being removably connected to said waist strap assembly.

* * * * *